US010954847B2

(12) United States Patent
Choi et al.

(10) Patent No.: US 10,954,847 B2
(45) Date of Patent: Mar. 23, 2021

(54) APPARATUS FOR CONTROLLING VALVE OF COOLANT CIRCULATION SYSTEM AND METHOD THEREOF

(71) Applicants: HYUNDAI MOTOR COMPANY, Seoul (KR); KIA MOTORS CORPORATION, Seoul (KR)

(72) Inventors: Chang Eun Choi, Suwon-si (KR); Young Ho Jung, Seoul (KR); Won Jun Sung, Seoul (KR); Hyuk Jun Lee, Yongin-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/660,592

(22) Filed: Oct. 22, 2019

(65) Prior Publication Data

US 2020/0400061 A1 Dec. 24, 2020

(30) Foreign Application Priority Data

Jun. 20, 2019 (KR) ..... 10-2019-0073454

(51) Int. Cl.
*F01P 7/14* (2006.01)
*F01P 5/10* (2006.01)

(52) U.S. Cl.
CPC ..... *F01P 7/14* (2013.01); *F01P 5/10* (2013.01); *F01P 2007/146* (2013.01); *F01P 2025/30* (2013.01); *F01P 2025/50* (2013.01); *F01P 2037/00* (2013.01)

(58) Field of Classification Search
CPC ..... F01P 2011/205; Y02E 60/14; B60H 1/00492; B60H 1/00885; F28D 20/0034
USPC ..... 123/41.08
See application file for complete search history.

(56) References Cited

U.S. PATENT DOCUMENTS

2002/0035972 A1* 3/2002 Suzuki ..... B60H 1/00885 123/41.14
2002/0195068 A1* 12/2002 Ichinose ..... F01P 11/20 123/41.14
2010/0186685 A1* 7/2010 Hiyama ..... B60H 1/00492 123/41.08
2013/0255602 A1* 10/2013 Haupts ..... F28D 20/00 123/41.14
2013/0269925 A1* 10/2013 Baruschke ..... F01P 11/20 165/287

* cited by examiner

*Primary Examiner* — Long T Tran
*Assistant Examiner* — James J Kim
(74) *Attorney, Agent, or Firm* — Morgan, Lewis & Bockius LLP

(57) ABSTRACT

An apparatus for controlling a vehicle includes a valve that introduces or blocks a coolant discharged from a coolant pump into latent heat storage, a first temperature sensor that measures a first coolant temperature discharged from the coolant pump, a second temperature sensor that measures a second coolant temperature in the latent heat storage, and a controller that controls opening and closing of the valve based on the first coolant temperature measured by the first temperature sensor and the second coolant temperature measured by the second temperature sensor.

10 Claims, 8 Drawing Sheets

APPARATUS FOR CONTROLLING VALVE OF COOLANT CIRCULATION SYSTEM AND METHOD THEREOF

CROSS-REFERENCE TO RELATED APPLICATION

This application claims the benefit of priority to Korean Patent Application No. 10-2019-0073454, filed in the Korean Intellectual Property Office on Jun. 20, 2019, the entire contents of which are incorporated herein by reference.

TECHNICAL FIELD

The present disclosure relates to controlling a valve of latent heat storage provided in a coolant circulation system of a vehicle.

BACKGROUND

In general, various methods of early raising the coolant temperature of a cold engine during cold start (engine initiation) of a vehicle have been proposed. These methods include a hardware method using an electronic coolant heater, a positive temperature coefficient (PTC) heater, a thermal management module (TMM) or an integrated thermal management (ITM), and a software method of increasing the idle revolution per minute (RPM) of an engine.

The disclosure of this section is to provide background of the invention. Applicant notes that this section may contain information available before this application. However, by providing this section, Applicant does not admit that any information contained in this section constitutes prior art.

SUMMARY

An aspect of the present disclosure provides an apparatus for controlling a valve of a coolant circulation system of a vehicle, which is capable of controlling a valve for introducing or blocking coolant into latent heat storage in the coolant circulation system based on the temperature of the coolant, such that the durability of the latent heat storage is prevented from being deteriorated due to the high temperature coolant and the temperature of the coolant is prevented from dropping rapidly in the process of storing heat in the latent heat storage, and a method thereof.

According to an aspect of the present disclosure, an apparatus for controlling a vehicle includes a valve that introduces or blocks a coolant discharged from a coolant pump into latent heat storage, a first temperature sensor that measures a first coolant temperature discharged from the coolant pump, a second temperature sensor that measures a second coolant temperature in the latent heat storage, and a controller that controls opening and closing of the valve based on the first coolant temperature measured by the first temperature sensor and the second coolant temperature measured by the second temperature sensor.

The controller may open the valve to increase the first coolant temperature when an engine is initiated.

The controller may open the valve when the second coolant temperature is higher than the first coolant temperature by a first threshold temperature or more and may close the valve when a time period for which the first coolant temperature exceeds the second coolant temperature passes a threshold time.

The controller may delay an opening time of a main valve to increase a rising rate of the first coolant temperature when the valve is opened.

The controller may control opening and closing of the valve to prevent the first coolant temperature from deviating from a reference range when heat is stored in the latent heat storage.

The controller may store heat in the latent heat storage by repeating an operation in which the valve is opened when a time period for which the first coolant temperature exceeds the second coolant temperature passes a threshold time and is closed when the first coolant temperature falls below a third threshold temperature.

The controller may no longer open the valve when the first coolant temperature exceeds a fourth threshold temperature.

According to an aspect of the present disclosure, a method of controlling a valve includes measuring, by a first temperature sensor, a first coolant temperature discharged from a coolant pump, measuring, by a second temperature sensor, a second coolant temperature in latent heat storage, and controlling, by a controller, the valve through which a coolant discharged from the coolant pump is introduced or blocked into the latent heat storage, based on the measured first coolant temperature and the measured second coolant temperature.

The controlling of the value may include controlling opening and closing of the valve to increase the first coolant temperature when an engine is initiated.

The controlling of the value may include opening the valve when the second coolant temperature is higher than the first coolant temperature by a first threshold temperature or more, and closing the valve when a time period for which the first coolant temperature exceeds the second coolant temperature passes a threshold time.

The controlling of the value may include delaying an opening time of a main valve to increase a rising rate of the first coolant temperature when the valve is opened.

The controlling of the value may include controlling opening and closing of the valve to prevent the first coolant temperature from deviating from a reference range when heat is stored in the latent heat storage.

The controlling of the value may include opening the valve when a time period for which the first coolant temperature exceeds the second coolant temperature passes a threshold time, and closing the valve when the first coolant temperature falls below a third threshold temperature.

The controlling of the value may further include allowing the valve to be no longer opened when the first coolant temperature exceeds a fourth threshold temperature.

BRIEF DESCRIPTION OF THE DRAWINGS

The above and other aspects, features and advantages of the present disclosure will be more apparent from the following detailed description taken in conjunction with the accompanying drawings.

DETAILED DESCRIPTION

Figure 1:
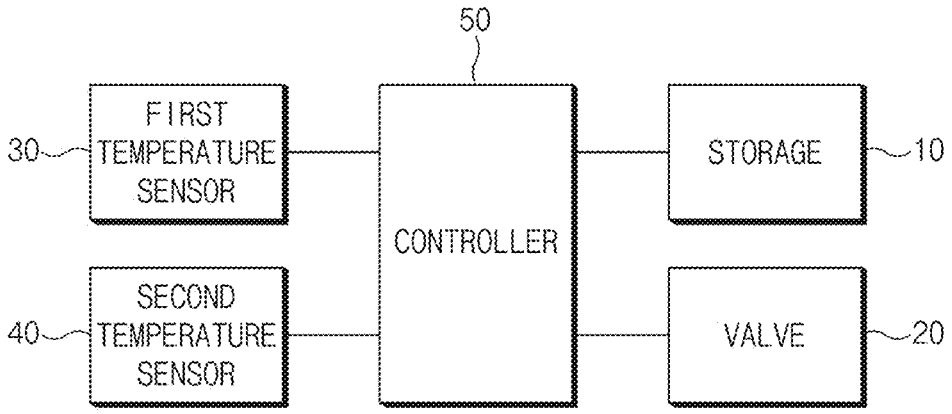
FIG. 1 is a block diagram illustrating an apparatus for controlling a valve of a coolant circulation system according to an embodiment of the present disclosure.

Hereinafter, some embodiments of the present disclosure will be described in detail with reference to the drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

In describing the components of the embodiment according to the present disclosure, terms such as first, second, "A", "B", (a), (b), and the like may be used. These terms are merely intended to distinguish one component from another component, and the terms do not limit the nature, sequence or order of the constituent components. Unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

In one implementation of a method of raising the temperature of coolant, latent heat storage (LHS) is installed in parallel to one outlet side line of the coolant pump provided in a coolant circulation system (or an engine cooling system), and a controller controls a valve to allow the coolant heated by an engine to pass through the latent heat storage to store the heat in the latent heat storage. In addition, the controller controls the value to allow the cold coolant to pass through the latent heat storage during cold start to raise the coolant temperature.

In the foregoing valve control device, during the process of storing heat in the latent heat storage for using the latent heat storage during cold start, the high temperature coolant flows into the latent heat storage, thereby reducing the durability of the latent heat storage. In addition, due to the difference between the coolant temperature discharged from a coolant pump and the coolant temperature in the latent heat storage, the coolant temperature discharged from the coolant pump rapidly drops.

FIG. 1 is a block diagram illustrating an apparatus for controlling a valve of a coolant circulation system according to an embodiment of the present disclosure.

As shown in FIG. 1, an apparatus 100 for controlling a valve of a coolant circulation system according to an embodiment of the present disclosure may include storage 10, a valve 20, a first temperature sensor 30, a second temperature sensor 40, and a controller 50. In this case, according to a scheme of implementing the apparatus 100 for controlling a valve of a coolant circulation system according to an embodiment of the present disclosure, components may be combined with each other and implemented as one, and some components may be omitted.

Inspecting the components, first, the storage 10 may store various logic, algorithms and programs required in the process of controlling the valve 20 for introducing or blocking the coolant to latent heat storage 290 in the coolant circulation system of a vehicle based on the temperature of a coolant.

The storage 10 may store various threshold values required in the process of controlling the valve 20 for introducing or blocking the coolant to the latent heat storage 290 based on the temperature of the coolant in the coolant circulation system of the vehicle.

For example, the storage 10 may store a first threshold temperature (e.g., 20° C.), a second threshold temperature (e.g., 90° C.), a third threshold temperature (e.g., 85° C.), a fourth threshold temperatures (e.g., 100° C.), a threshold time (e.g., 5 seconds), and the like.

The storage 10 may include at least one type of a storage medium of memories of a flash memory type, a hard disk type, a micro type, a card type (e.g., a secure digital (SD) card or an eXtreme digital (XD) card), and the like, and a random access memory (RAM), a static RAM, a read-only memory (ROM), a programmable ROM (PROM), an electrically erasable PROM (EEPROM), a magnetic memory (MRAM), a magnetic disk, and an optical disk type memory.

Next, the valve 20 is located in one outlet line of a coolant pump 210 provided in the coolant circulation system of the vehicle to bypass the coolant pumped by the coolant pump 210 to the latent heat storage 290. In embodiments, the valve 20 serves to introduce or block the coolant from the coolant pump 210 to the latent heat storage 290 under control of the controller 50.

Next, the first temperature sensor 30 is located on one outlet line of the coolant pump 210 to measure the temperature of the coolant discharged from the coolant pump 210 (hereinafter, the first coolant temperature).

Next, the second temperature sensor 40 is located inside the latent heat storage 290 to measure the temperature of the coolant stored in the latent heat storage 290 (hereinafter, the second coolant temperature).

Next, the controller 50 performs the overall control such that each of the above components may perform the normal function. The controller 50 may be implemented in hardware or software, and of course, may be implemented in a combination of hardware and software. In one example, the controller 50 may be implemented as a microprocessor, but is not limited thereto.

The controller 50 may control the opening and closing of the valve 20 based on the first coolant temperature measured by the first temperature sensor 30 and the second coolant temperature measured by the second temperature sensor 40.

Inspecting this in more detail, when the engine is initiated and the second coolant temperature is higher than the first coolant temperature by a first threshold temperature or more, the controller 50 opens the valve 20 such that the coolant discharged from the coolant pump 210 passes through the latent heat storage 290.

Thereafter, the controller 50 determines that the heat stored in the latent heat storage 290 is exhausted when the time for which the first coolant temperature exceeds the second coolant temperature passes a threshold time, thereby closing the valve 20. Thus, the function of the latent heat storage 290 for raising the first coolant temperature is completed.

Hereinafter, the process of storing heat in the latent heat storage 290, wherein the heat is used to raise the first coolant temperature later during the initiation of the engine will be described.

The controller 50 determines that the first coolant temperature reaches a temperature suitable for storing heat into the latent heat storage 290 when the time for which the first coolant temperature exceeds the second threshold temperature passes the threshold time, and thus, opens the valve 20.

In this case, the controller 50 continuously monitors the first coolant temperature and controls the opening and closing of the valve 20, such that the temperature of the coolant supplied to the heat storage 290 is higher than, e.g., the third threshold temperature. In embodiments, the process of closing and opening the valve is repeated, in which the valve 20 is closed when the first coolant temperature drops below the third threshold temperature and the valve 20 is opened when the time for which the first coolant temperature exceeds the second threshold temperature passes the threshold time.

As a result, the controller 50 controls the opening and closing of the valve 20 to prevent the temperature of the coolant supplied to the storage 290 from deviating from the reference range. In one embodiment, the controller 50 controls the opening and closing of the valve 20 to maintain the temperature of the coolant supplied to the storage 290 within the reference range.

Thereafter, the controller 50 closes the valve 20 to prevent a thermal shock applied to the latent heat storage when the first coolant temperature exceeds, for example, the fourth threshold temperature. In this case, the controller 50 does not open the valve 20 any more until the engine is stopped.

In the embodiment of the present disclosure, although the controller 50 has been described as an example of implementing the controller 50 in a separate configuration, it may be implemented to allow an engine control unit (ECU) provided in the vehicle to perform the function of the controller 50.

In addition, according to an embodiment of the present disclosure, the apparatus may further include a third temperature sensor for measuring the temperature of the coolant passing through a head 230 of the engine, and the first temperature sensor 30 may be replaced with the third temperature sensor.

Figure 2:
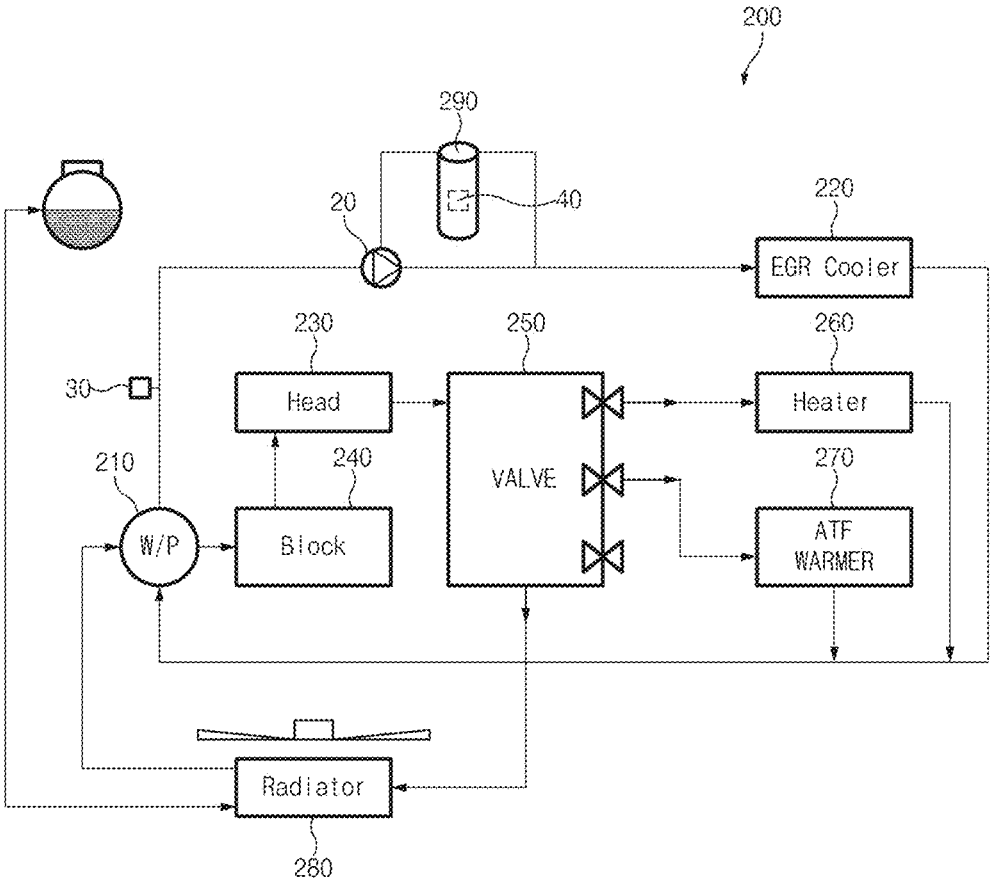
FIG. 2 is a first diagram of a coolant circulation system to which an embodiment is applied.

FIG. 2 is a first diagram of a coolant circulation system to which an embodiment is applied.

As shown in FIG. 2, a coolant circulation system 200 to which an embodiment of the present disclosure is applied may include the valve control apparatus 100, the coolant pump 210, an exhaust gas recirculation (EGR) cooler 220, the cylinder head 230, a cylinder block 240, a main valve 250, a heater 260, an automatic transmission fluid (ATF) warmer 270, a radiator 280, and the latent heat storage 290.

The valve 20 may be located on one outlet line of the coolant pump 210 and may bypass the coolant pumped by the coolant pump 210 to the latent heat storage 290 under control of the controller 50.

The first temperature sensor 30 may be located on one outlet line of the coolant pump 210 to measure the temperature of the coolant discharged (pumped) from the coolant pump 210.

The second temperature sensor 40 may be located inside the latent heat storage 290 to measure the temperature of the coolant in the latent heat storage 290.

The coolant pump 210 may pump the coolant such that the pumped coolant may be introduced into the valve 20 and the cylinder block 240.

The main valve 250 may include a thermal management module (TMM) or integrated thermal management (ITM), may be arranged on the coolant outlet line of the cylinder head 230, and may distribute the coolant discharged from the cylinder head 230 or the cylinder block 240. In this case, the main valve 250 may distribute the coolant to the heater 260, the ATF warmer 270, and the radiator 280 under control of the controller 50 or ECU.

A circulation line for introducing the coolant discharged from one outlet of the coolant pump 210 to one inlet of the coolant pump 210 may be formed, and the EGR cooler 220 may be arranged on the circulation line. Therefore, when the coolant pump 210 operates, the coolant is circulated through the EGR cooler 220.

The heater 260 and the ATF warmer 270 may be provided on mutually different coolant circulation lines, and the main valve 250 may control the flows of the coolants passing through the heater 260 and the ATF warmer 270, respectively.

Meanwhile, when the controller 50 opens the valve 20 to increase the first coolant temperature during initiating of the engine, the opening time of the main valve 250 may be delayed to increase the increasing rate of the coolant temperature. In embodiments, the main valve 250 may be maintained in a closed state for a longer time than the existing one, thereby increasing the increasing rate of the coolant temperature.

Figure 3:
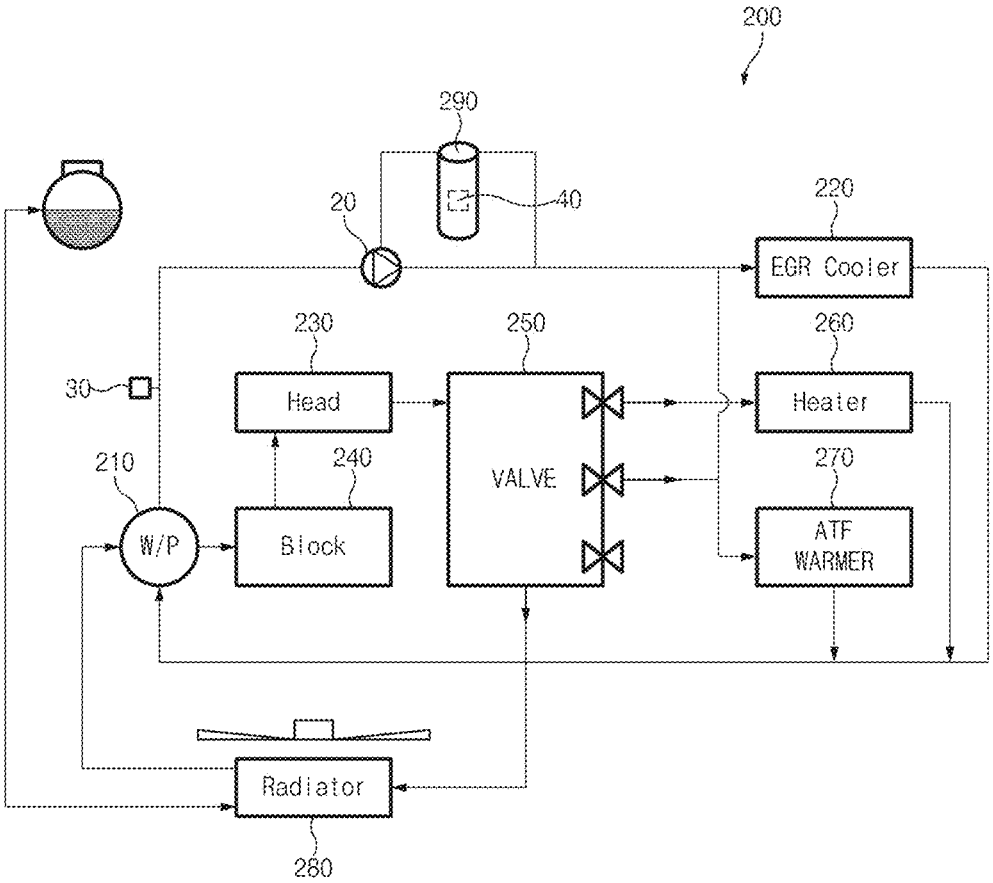
FIG. 3 is a second diagram of a coolant circulation system to which an embodiment is applied.
Figure 4:
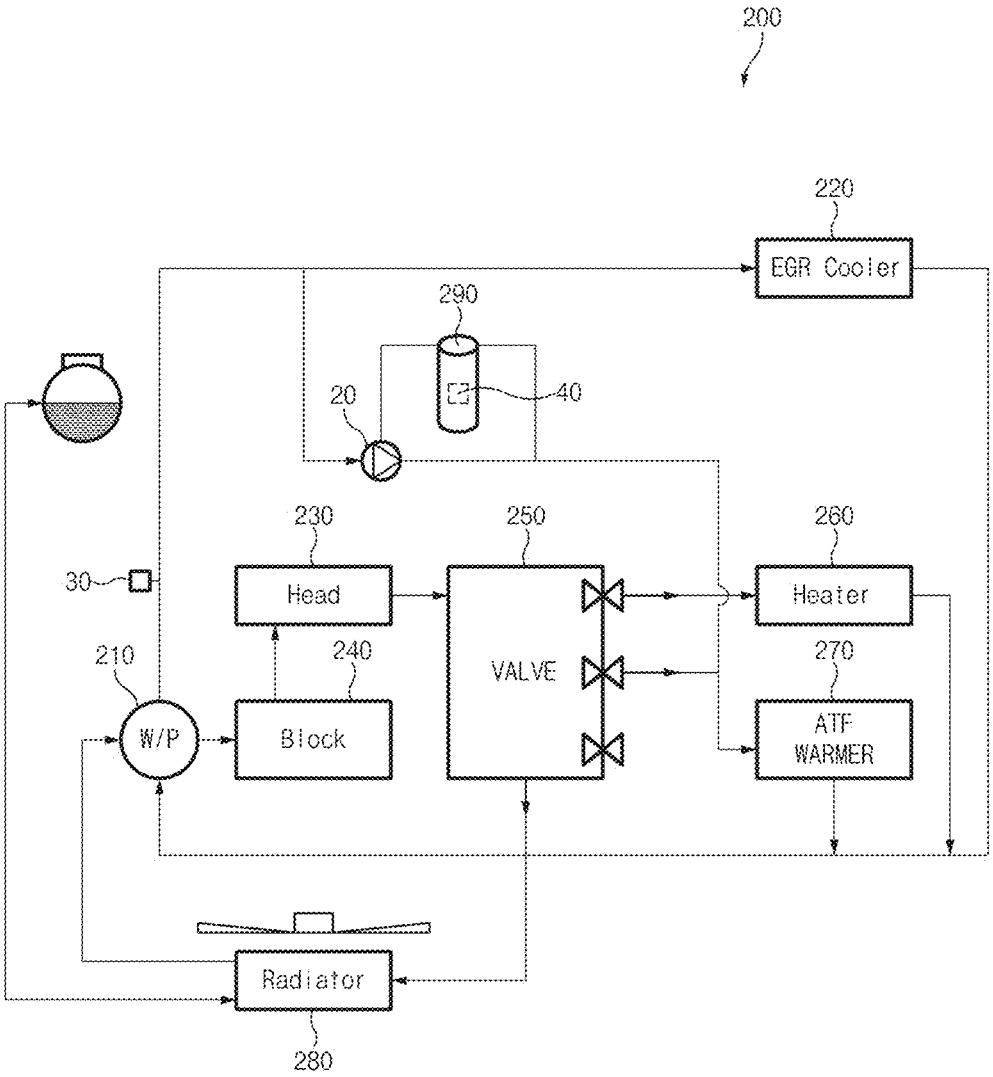
FIG. 4 is a third diagram of a coolant circulation system to which an embodiment is applied.
Figure 5:
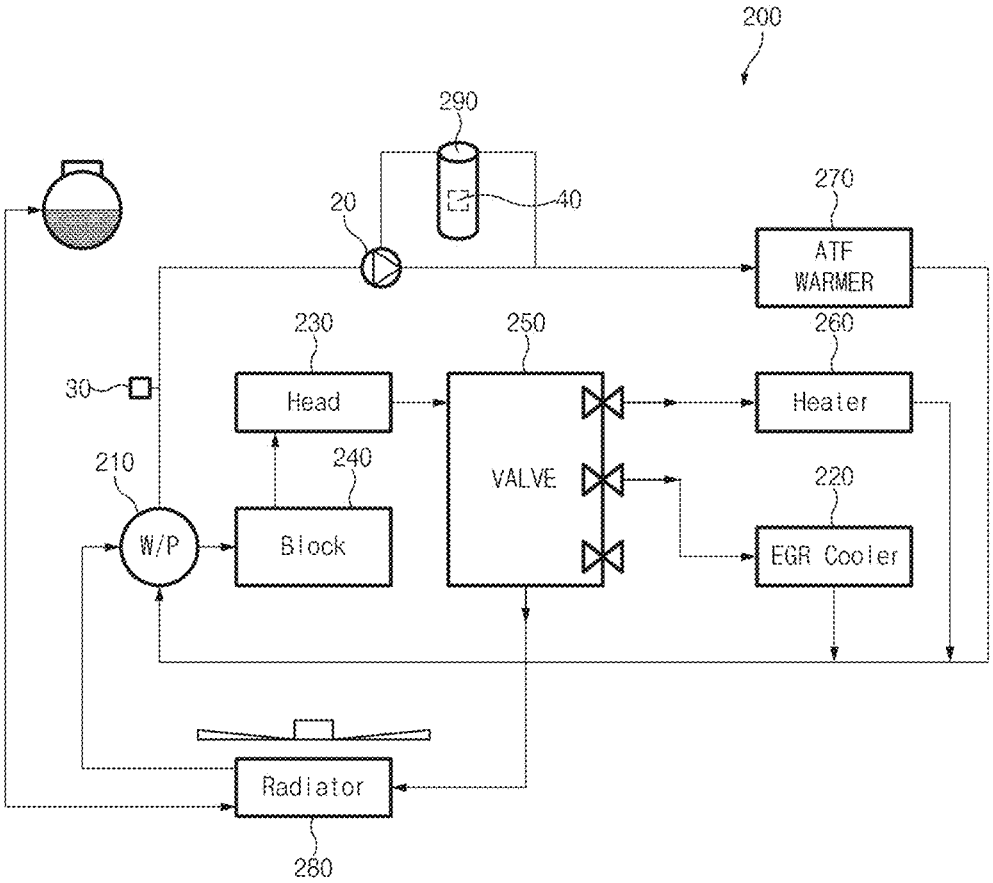
FIG. 5 is a fourth diagram of a coolant circulation system to which an embodiment is applied.

As shown in FIGS. 3 to 5, the valve control apparatus 100 of the coolant circulation system according to an embodiment of the present disclosure may be applied to various types of coolant circulation systems.

FIG. 3 illustrates a case where the latent heat storage 290 is located in front of the EGR cooler 220 and the ATF warmer 270. FIG. 4 illustrates a case where the latent heat storage 290 is located in front of the ATF warmer 270. FIG. 5 illustrates a case where the latent heat storage 290 is located in front of the ATF warmer 270 in a state where the positions of the front ends of the EGR cooler 220 and the ATF warmer 270 are changed compared to FIG. 4.

Figure 6:
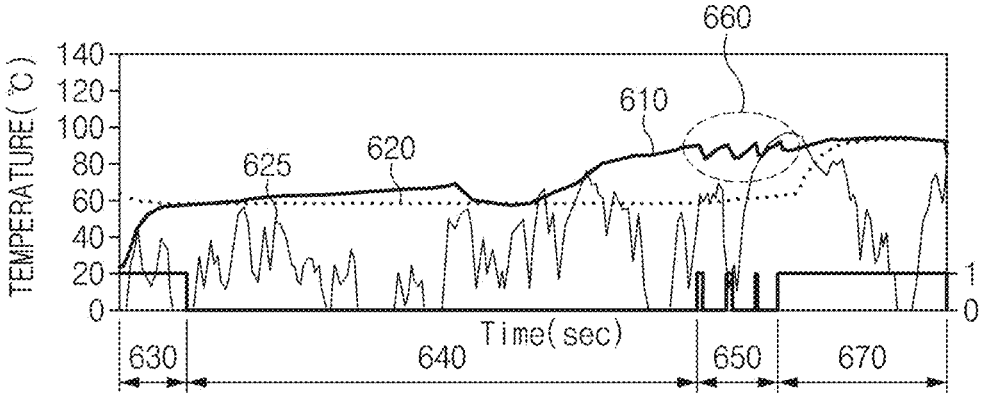
FIG. 6 is a view illustrating a process of storing heat in latent heat storage by a valve control apparatus of a coolant circulation system according to an embodiment of the present disclosure.

FIG. 6 is a view illustrating a process of storing heat in the latent heat storage by the valve control apparatus of the coolant circulation system according to an embodiment of the present disclosure.

In FIG. 6, reference numeral 610 denotes a graph showing the first coolant temperature, reference numeral 620 denotes a graph showing the second coolant temperature, and reference numeral 625 denotes a graph showing the speed of a vehicle.

As shown in FIG. 6, in section 630, the controller 50 opens the valve 20 during initiating of the engine such that the latent heat of the latent heat storage 290 is transferred to the coolant. In this case, the section 630 means the opening '1' of the valve 20.

Thereafter, in section 640, when the time for which the first coolant temperature exceeds the second coolant temperature passes a threshold time, the controller 50 determines that the heat stored in the latent heat storage 290 is fully exhausted and closes the valve 20. In this case, the section 640 means the closing '0' of the valve 20.

Then, in section 650, the controller 50 controls the opening and closing of the valve 20 to prevent the first coolant temperature from deviating from the reference range in the process of storing heat in the latent heat storage 290. As a result, it may be understood that the first coolant temperature does not deviate from the reference range as denoted by reference numeral 660. In this case, the opening and closing of the valve 20 are repeated in the section 650.

Thereafter, when the first coolant temperature rises sufficiently, in section 670, the opening of the valve 20 is maintained such that the second coolant temperature 620 in the latent heat storage 290 and the temperature of a phase change material (PCM) are increased. In this case, it means the opening '1' of the valve 20 in the section 670.

Figure 7:
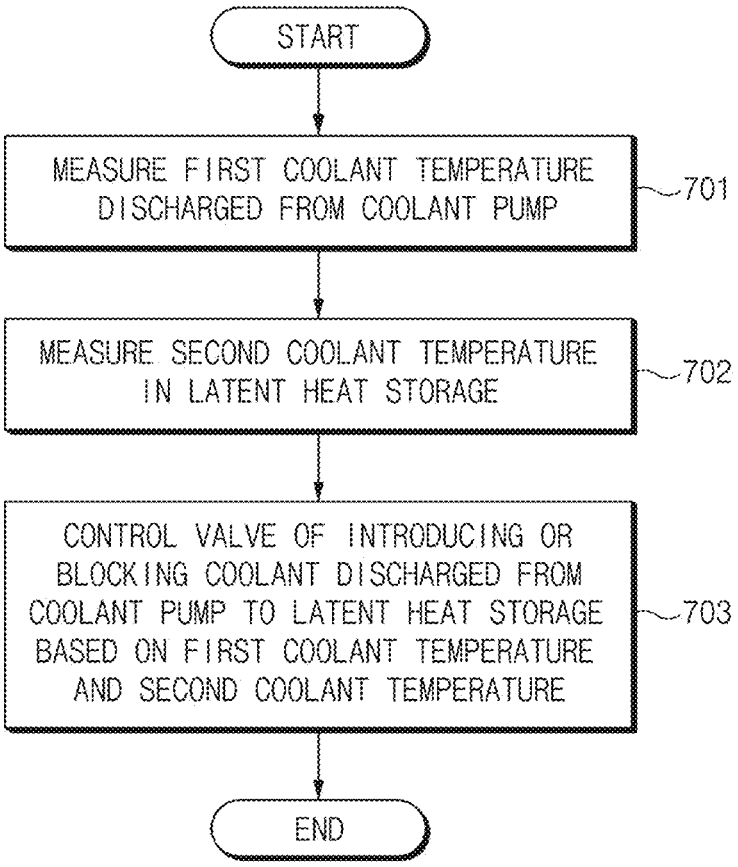
FIG. 7 is a flowchart illustrating a method of controlling a valve of a coolant circulation system according to an embodiment of the present disclosure.

FIG. 7 is a flowchart illustrating a method of controlling a valve of a coolant circulation system according to an embodiment of the present disclosure.

First, in operation 701, the first temperature sensor 30 measures the first coolant temperature discharged from the coolant pump 210.

Then, in operation 702, the second temperature sensor 40 measures the second coolant temperature in the latent heat storage 290.

Then, in operation 703, the controller 50 controls the valve 20 that introduces or blocks the coolant discharged from the coolant pump 210 to the latent heat storage 290, based on the first coolant temperature measured by the first temperature sensor 30 and the second coolant temperature measured by the second temperature sensor 40.

Figure 8:
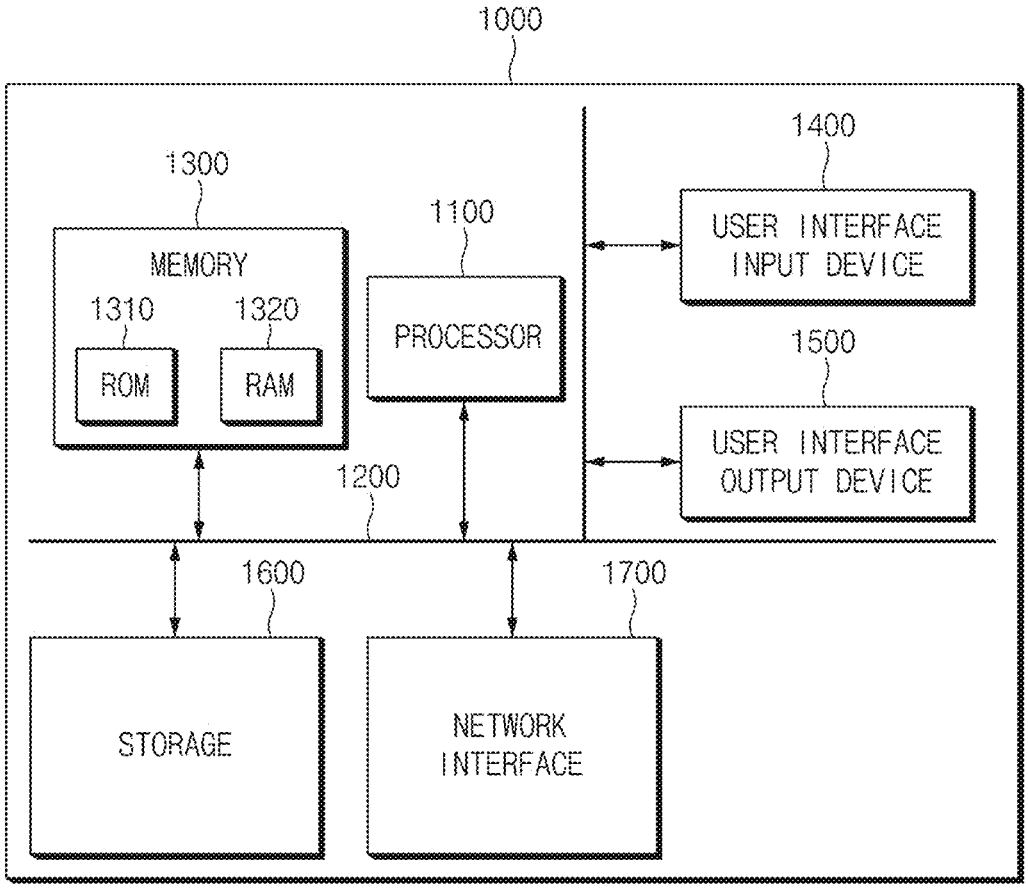
FIG. 8 is a view illustrating a computing system that executes a method of controlling a valve of a coolant circulation system according to an embodiment of the present disclosure.

FIG. 8 is a view illustrating a computing system that executes a method of controlling a valve of a coolant circulation system according to an embodiment of the present disclosure.

Referring to FIG. 8, a method of controlling a valve of a coolant circulation system according to an embodiment of the present disclosure may be implemented through a computing system. A computing system 1000 may include at least one processor 1100, a memory 1300, a user interface input device 1400, a user interface output device 1500, storage 1600, and a network interface 1700, which are connected with each other via a bus 1200.

The processor 1100 may be a central processing unit (CPU) or a semiconductor device that processes instructions stored in the memory 1300 and/or the storage 1600. The memory 1300 and the storage 1600 may include various types of volatile or non-volatile storage media. For example, the memory 1300 may include a ROM (Read Only Memory) and a RAM (Random Access Memory).

Thus, the operations of the method or the algorithm described in connection with the embodiments disclosed herein may be embodied directly in hardware or a software module executed by the processor 1100, or in a combination thereof. The software module may reside on a storage medium (e.g., the memory 1300 and/or the storage 1600) such as a RAM, a flash memory, a ROM, an EPROM, an EEPROM, a register, a hard disk, a removable disk, a CD-ROM. The storage medium may be coupled to the processor 1100, and the processor 1100 may read information out of the storage medium and may record information in the storage medium. Alternatively, the storage medium may be integrated with the processor 1100. The processor 1100 and the storage medium may reside in an application specific integrated circuit (ASIC). The ASIC may reside within a user terminal. In another case, the processor 1100 and the storage medium may reside in the user terminal as separate components.

In an apparatus for controlling a valve of a coolant circulation system of a vehicle and a method thereof according to an embodiment, the valve for introducing or blocking coolant into the latent heat storage in the coolant circulation system may be controlled based on the temperature of the coolant, such that the durability of the latent heat storage is prevented from being deteriorated due to the high temperature coolant and the temperature of the coolant is prevented from dropping rapidly in the process of storing heat in the latent heat storage.

Logical blocks, modules or units described in connection with embodiments disclosed herein can be implemented or performed by a computing device having at least one processor, at least one memory and at least one communication interface. The elements of a method, process, or algorithm described in connection with embodiments disclosed herein can be embodied directly in hardware, in a software module executed by at least one processor, or in a combination of the two. Computer-executable instructions for implementing a method, process, or algorithm described in connection with embodiments disclosed herein can be stored in a non-transitory computer readable storage medium.

Hereinabove, although the present disclosure has been described with reference to embodiments and the accompanying drawings, the present disclosure is not limited thereto, but may be variously modified and altered by those skilled in the art to which the present disclosure pertains without departing from the spirit and scope of the present disclosure claimed in the following claims.

Therefore, the embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims, and all the technical ideas within the scope equivalent to the claims should be included in the scope of the present disclosure.

What is claimed is:

1. An apparatus for controlling a vehicle, the apparatus comprising:

a valve configured to introduce or block a flow of coolant discharged from a coolant pump into a latent heat storage;

a first temperature sensor configured to measure a first coolant temperature of the coolant discharged from the coolant pump;

a second temperature sensor configured to measure a second coolant temperature of the coolant stored in the latent heat storage; and a controller configured to control opening and closing of the valve based on the first coolant temperature measured by the first temperature sensor and the second coolant temperature measured by the second temperature sensor, wherein the controller is configured to open the valve to increase the first coolant temperature when an engine is initiated, wherein the controller is configured to delay an opening time of a main valve to increase a rising rate of the first coolant temperature when the valve is opened.

2. The apparatus of claim 1, wherein the controller is configured to open the valve when the second coolant temperature is higher than the first coolant temperature by a first threshold temperature or more and to close the valve when a time period for which the first coolant temperature exceeds the second coolant temperature passes a threshold time.

3. The apparatus of claim 1, wherein the controller is configured to control opening and closing of the valve to prevent the first coolant temperature from deviating from a reference range when heat is stored in the latent heat storage.

4. The apparatus of claim 3, wherein the controller is configured to control the valve such that heat is stored in the latent heat storage by repeating an operation in which the valve is opened when a time period for which the first coolant temperature exceeds the second coolant temperature passes a threshold time and is closed when the first coolant temperature falls below a third threshold temperature.

5. The apparatus of claim 4, wherein the controller is configured to no longer open the valve when the first coolant temperature exceeds a fourth threshold temperature.

6. A method of controlling a valve, the method comprising:

measuring, by a first temperature sensor, a first coolant temperature of coolant discharged from a coolant pump;

measuring, by a second temperature sensor, a second coolant temperature of the coolant stored in a latent heat storage; and controlling, by a controller, the valve through which a coolant discharged from the coolant pump is introduced or blocked into the latent heat storage, based on the measured first coolant temperature and the measured second coolant temperature, wherein the controller is configured to open the valve to increase the first coolant temperature when an engine is initiated, wherein the controller is configured to delay an opening time of a main valve to increase a rising rate of the first coolant temperature when the valve is opened.

7. The method of claim 6, wherein the controlling of the value includes:

opening the valve when the second coolant temperature is higher than the first coolant temperature by a first threshold temperature or more; and closing the valve when a time period for which the first coolant temperature exceeds the second coolant temperature passes a threshold time.

8. The method of claim 6, wherein the controlling of the value includes controlling opening and closing of the valve to prevent the first coolant temperature from deviating from a reference range when heat is stored in the latent heat storage.

9. The method of claim 8, wherein the controlling of the value includes:

opening the valve when a time period for which the first coolant temperature exceeds the second coolant temperature passes a threshold time; and closing the valve when the first coolant temperature falls below a third threshold temperature.

10. The method of claim 9, wherein the controlling of the value further includes allowing the valve to be no longer opened when the first coolant temperature exceeds a fourth threshold temperature.

* * * * *